United States Patent [19]

Kaiser et al.

[11] 3,951,785

[45] Apr. 20, 1976

[54] CLASSIFICATION BY FERROFLUID DENSITY SEPARATION

[75] Inventors: Robert Kaiser, Winchester; Leon Mir, Brookline, both of Mass.; Richard A. Curtis, Seattle, Wash.

[73] Assignee: Avco Corporation, Cincinnati, Ohio

[22] Filed: Jan. 29, 1975

[21] Appl. No.: 545,240

[52] U.S. Cl. ..... 209/1

[51] Int. Cl.[2] ..... B03B 5/00; B03B 13/04

[58] Field of Search ..... 209/1, 172.5; 252/21, 252/62.56; 310/10

[56] References Cited

UNITED STATES PATENTS

| | | | |
|---|---|---|---|
| 3,483,968 | 12/1969 | Kaiser | 209/1 |
| 3,483,969 | 12/1969 | Rosensweig | 209/1 |
| 3,488,531 | 1/1970 | Rosensweig | 310/10 |
| 3,531,413 | 9/1970 | Rosensweig | 252/62.62 |
| 3,700,595 | 10/1972 | Kaiser | 252/62.56 |
| 3,784,471 | 1/1974 | Kaiser | 252/21 |
| 3,788,465 | 1/1974 | Reimers et al. | 209/1 |
| 3,806,449 | 4/1974 | Kaiser | 210/40 |

OTHER PUBLICATIONS

International Science and Technology, July 1966, "Magnetic Fluids", pp. 48–54 and 56; R. E. Rosensweig.

*Primary Examiner*—Frank W. Lutter
*Assistant Examiner*—Ralph J. Hill
*Attorney, Agent, or Firm*—Charles M. Hogan; Abraham Ogman

[57] ABSTRACT

A method of separating non-magnetic particles of different densities by using a ferrofluid to produce levitation wherein compensation is made for the magnetic attraction or interaction of the particles by removing particles too small for the desired sharpness of separation or by maintaining the ratio of the interaction force to the separation force outside of theoretical limits.

5 Claims, 6 Drawing Figures

CLASSIFICATION BY FERROFLUID DENSITY SEPARATION

BACKGROUND OF THE INVENTION

1. Field of the Invention

The present invention relates generally to methods for separating particles of different densities and more specifically to a method for separating of such particles using the levitational properties of a ferrofluid.

2. Description of the Invention

There exist standard methods of separating two or more solids which depend on the differences in the densities of the components. The most common method involves sink-float separation in a liquid medium. Sink-float separation operates on the principle that when two objects of different density are immersed in a fluid of intermediate density, the less dense will float and the more dense will sink. The separation is completed by individually removing the two solid fractions. While simple in principle, solids separation by the classical sink-float method has a number of severe shortcomings. These include:

a. Pure liquids or solutions do not cover the range of densities of interest. Most liquids have low densities whereas most solids have high densities. There are very few materials that are liquid at ambient temperature and exhibit a density greater than 2 gr/cm$^3$.

b. An accurate sink-float separation is obtained only if there is complete liberation of the different particles in the solid mixture. It is necessary to ensure that a sample of very fine particles is well dispersed in the sink-float medium. Otherwise, agglomerates will behave as individual particles with a density intermediate those of the ultimate particles in the agglomerate, thereby resulting in poor separation.

c. The density of a given liquid is a constant value which is not readily varied. Changes in temperature will only result in small variations in the liquid density. In order to obtain different density cuts, it is necessary to carry out a series of sink-float separations in different liquids of varying densities.

Use of a ferrofluid and a magnetic field to create an apparent high ferrofluid density permits sink-float separation of non-magnetic solids according to their density. Some of the problems outlined above are resolved by the controlled density aspect of ferrofluids.

Ferrofluids are stable colloidal dispersions of superparamagnetic particles (diameter (d) $\approx$ 0.01 microns). These dispersions retain their liquid properties in a magnetic field. By proper choice of stabilizing agents, magnetic properties can be conferred to a wide range of liquids which include water, hydrocarbons and fluorocarbons. These colloidal dispersions form a unique class of magnetic liquids in which it is possible to induce substantial magnetic body forces. One of the unusual properties of a ferrofluid is that its apparent density may be made significantly greater than its true physical density by the application of a magnetic field. With a properly designed electromagnet, the apparent density of a ferrofluid may be varied from less than 1 gr/cm$^3$ to more than 25 gr/cm$^3$, thereby permitting flotation of any element in the periodic table. The concepts involved are more fully discussed in U.S. Pat. Nos. 3,483,968; 3,483,969; and 3,488,531, which are commonly assigned to the assignee hereof and are incorporated herein by reference.

SUMMARY OF THE INVENTION

The present invention applies the principles of ferrofluid separation to density separation systems, and in particular, to classifying particles sharply, i.e., into relatively pure fractions.

OBJECTS OF THE INVENTION

An object of the present invention is to provide an improved method for cleanly separating small particles of different densities using the levitation technique of a ferrofluid separator.

Another object of the present invention is to provide a method of separating particles having a small difference in density.

Still another object of the present invention is to provide a method of separating particles where the product of ($\Delta\rho D$) is less than 5.0 gr/cm$^2$, where $\Delta\rho$ is the difference in densities and D is the diameter of the particles.

Yet another object of the present invention is a procedure wherein the process parameters are broader than the theoretical limits.

Another object of the present invention is to improve the ferrofluid levitation theory used for a particle separation by compensating for the magnetic attraction of the particles due to their size.

Other objects, advantages, and novel features of the present invention will become apparent from the following detailed description of the invention when considered in conjunction with the accompanying drawings.

DESCRIPTION OF THE PREFERRED EMBODIMENTS

Sink/float separators using ferrofluids have heretofore dealt with the separation of macroscopic objects (as exemplified by the three previously mentioned patents). A number of factors which can be neglected in separation of macroscopic objects must be taken into account to separate fine particles cleanly according to their densities. These include the interaction of non-magnetic particles immersed in a ferrofluid in a magnetic field and the settling characteristics of fine particles in a viscous fluid. Another important consideration is the relative densities of the particles that are to be separated.

In a ferrofluid separator, a body of ferrofluid is held between the poles of an electromagnet which generates a magnetic field with a constant gradient; directed downward, in the direction of gravity. Consequently, a non-magnetic object immersed in the ferrofluid pool experiences a reverse force in the upward direction. By regulating the strength of the magnetic field gradient and the strength of the ferrofluid, this reverse magnetic force can be made larger or smaller than the force of gravity on the non-magnetic object. When the reverse magnetic force is larger than the force of gravity, the object will float even though its density is greater than the density of the ferrofluid. When the reverse magnetic force is less than the force of gravity, the object sinks.

In a suitable magnetic field with a gradient parallel to gravity, a ferrofluid can be viewed as a liquid that has a controllable apparent density:

$$\rho a = \rho F + \frac{M(H)\Gamma}{g} \qquad (A)$$

where $\rho a$ = "apparent density" of the ferrofluid; gr/cm$^3$ $\rho F$ = physical or true density of ferrofluid; gr/cm$^3$ $M(H)$ = magnetic dipole mement of ferrofluid, emu; a function of the field strength, H $\Gamma$ = vertical gradient of magnetic field; oersted/cm $g$ = acceleration of gravity; cm/sec$^2$ This theoretical development is based on the case of an isolated non-magnetic object immersed in a ferrofluid which is positioned in a magnetic field gradient and does not take into account any interaction between immersed objects. In actual separation practice, the ferrofluid volume will contain many non-magnetic objects which are being separated from each other. The presence of these objects introduces perturbations in the externally applied magnetic field and its gradient. These perturbations result in particle-to-particle interaction forces.

An appreciation of the perturbations can be gained by analyzing likely interactions. For example, two adjacent non-magnetic spheres may be immersed in the ferrofluid side by side (as illustrated in FIG. 1A) or superposed as illustrated in FIG. 1B.

Figure 1A:
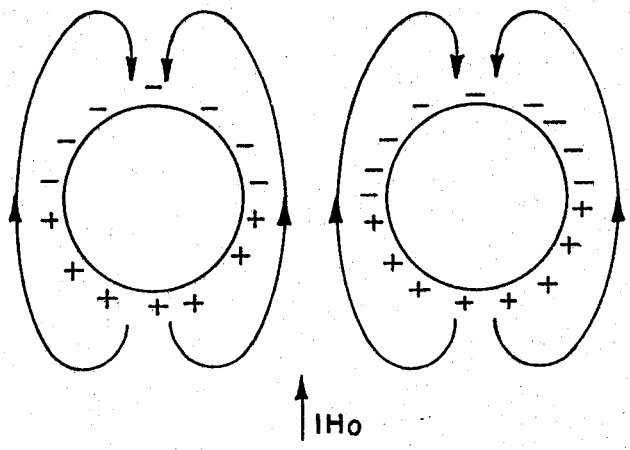
FIGS. 1A and 1B diagrammatically illustrate particle interaction inside a ferrofluid.
Figure 1B:
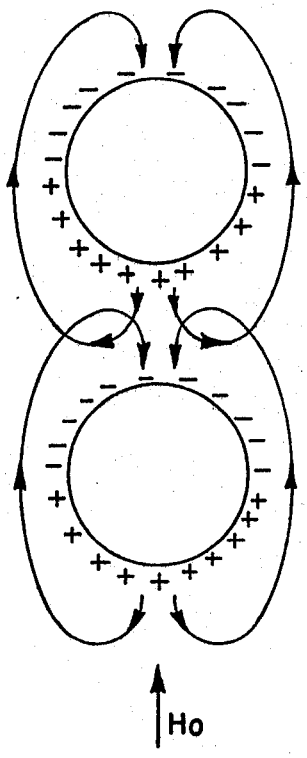

When the two spheres are in the configuration illustrated in FIG. 1A, the non-magnetic spheres cause an accumulation of positive "magnetic charge" on the sides facing the field and negative "magnetic charge" on the other sides. This charge in turn produces an additional magnetic field, some of whose field lines are drawn in FIG. 1. As this figure suggests, this perturbation field is in the same direction as the externally applied field, along a line joining the sphere centers, and is largest between them. Consequently, the ferrofluid which is of course attracted to regions of high magnetic field, moves into the region between the spheres, where the total sum of the external field and the perturbation field is highest. This movement of ferrofluid manifests itself as a repulsive force between the spheres of magnitude:

$$F_{ss} = 3\left(\frac{VM^2}{a^2}\right) \qquad (B)$$

where $V$ = volume of sphere $M$ = magnetic dipole moment per unit volume of ferrofluid $a$ = distance between sphere centers A similar analysis for the two superposed spheres whose line of centers is parallel to the direction of the externally applied field (FIG. 1B) shows that the spheres are subject to an attractive force of the same magnitude as the repulsive force of the first case. It is furthermore possible to show that this last configuration, with line of centers parallel to field direction, is the stable one, and that other initial configurations will drift to this stable one; which in the absence of other forces will eventually result in the mutual approach and touching of the spheres.

The force is given by the following equation:

$$F_{ss} = \left(\frac{(4\pi M)^2}{96}\right)\left(\frac{D^6}{a}4\right) \qquad (C)$$

where $a$ = center to center spacing between particles $D$ = diameter of the particles $M$ = magnetic dipole moment per unit volume of ferrofluid When the spheres consist of the two types that are to be separated by magnetic levitation, then half the difference in the net levitation force between the spheres must be greater than the above attraction force if separation is to take place. Half the difference in levitation force, $F_1$, between two spheres of identical volume $V$ but different densities situated in a ferrofluid pool is given by:

$$F_1 = \tfrac{1}{2}(\rho 2 - \rho 1)\, g\, V \qquad (D)$$

where $\rho^2$ = density of the more dense sphere $\rho^1$ = density of the less dense sphere $g$ = acceleration of gravity The dimensionless ratio $F_{ss}/F_1$, given by the following equation, should be an index of whether or not particle separation according to density will occur:

$$\frac{F_{ss}}{F_1} = \left(\frac{1}{8\pi}\right)\left(\frac{(4\pi M)^2}{(\rho 2-\rho 1)}\right)\left(\frac{D^3}{g\,a^4}\right) \qquad (1)$$

This ratio should be as small as practical for good separation to occur, but in any event less than 1. Consider the worst case, where the spheres touch and therefore $a = D$, $$\frac{F_{ss}}{F_1} = \left(\frac{1}{8\pi}\right)\left(\frac{(4\pi M)^2}{(\rho 2-\rho 1)}\right)\left(\frac{1}{gD}\right) \qquad (2)$$

A further result is that the magnetic field gradient must be increased to compensate for the reduction of ferrofluid magnetization in order to attain a given apparent ferrofluid density sufficient to float the less dense objects. See equation A.

Heretofore, when dealing with small particles in the laboratory, the practice was to use particles larger than 0.1 to 1 cm in diameter. Ferrofluid processes seemed to fall apart and became inoperative with smaller particles. The reasons were not then known, although based on the teachings of this invention, it is now appreciated that the ferrofluid magnetic dipole moment $M$ was too high.

Heretofore, it was also known that good separation could not be accomplished when the densities of the materials to be separated was less than 10 percent. The reasons eluded persons skilled in the art, and these parameters were avoided. Disaster struck when small particles of material having almost the same density were treated conventionally, that is, subjected to procedures that worked for macroscopic particles having significantly dissimilar densities.

To provide some idea of prior art practices, the procedures in the laboratory involved using ferrofluids where $4\pi M$ equalled 50–200 gauss, with particles of 0.1 cm to 1 cm in diameter. In scrap separation pilot plants, $4\pi M$ equals 200–500 gauss and particle sizes 0.6 to 8 cm were used.

There are a number of reasons for these limitations. The cause of the problems and their solutions were not known. The conventional thinking, we now know, led the practitioner in a direction away from solving the problems associated with small particles and materials with nearly the same densities. In the past, ferrofluid sink/float separation devices were designed to maximize $4\pi M$ and minimize the magnetic field gradient in order to minimize the power supplied to generate a suitable magnetic field.

With the development of Equation 2, it became clear that for a fixed value of the ratio $F_{ss}/F_1$, it is possible to compensate for small and fine particles and "like" densities by reducing the magnetization of the ferrofluid. Equation 2 directs the practitioner in a direction he was heretofore loath to take.

In practice for $F_{ss}/F_1$ equal to 10 or less (for reasons to be explained) and $(\rho_2 - \rho_1)D$ less than 5 gr/cm², the heretofore conventional practices and procedures are not operable. The limiting factor is no longer the power required to produce the gradient, but the selection of the magnetization which satisfies Equation 2. The gradient is then calculated using Equation (A) to adjust the ferrofluid to an intermediate density for performing such fluid separation. As a practical matter, the magnetization becomes the limiting factor when either the particle diameter is less than 1 cm. or the difference in density is less than 0.1.

The force ratio $F_{ss}/F_1$ can also be calculated using the average interparticle distance as the measure of particle separation. The average interparticle distance ($a$) can be expressed in terms of the volume concentration of powder particles ($\epsilon_v$) by:

$$\frac{a}{D} = \left(\frac{\pi}{6\epsilon_v}\right)^{1/3} \qquad (3)$$

assuming a cubic particle array. Thus Equation (1) becomes, when $a$ is equated to $D$:

$$\frac{F_{ss}}{F_1} = \frac{(4\pi M)^2}{8\pi(\rho 2 - \rho 1)gD}\left(\frac{6\epsilon_v}{\pi}\right)^{4/3} \qquad (4)$$

Equation (4) indicates that in actual practice particle concentration could have a significant effect on the quality of separation. This is a less severe criterion than Equation (2).

In order to test the validity of the theory of particle interactions, the effects of fluid magnetization (at an apparent ferrofluid density of 3.6 gm/cm³) and particle size on the separation of alundum ($\rho = 4.0$ gr/cm³) and silicon carbide ($\rho = 3.2$ gr/cm³) powders were examined.

EXAMPLE 1

In these tests the relative concentration of powder in the ferrofluid was approximately 0.05 by volume. The fluid magnetization and magnetic field gradient were varied in a manner such that the resulting apparent density of the ferrofluid was intermediate between the densities of the two powders so that the silicon carbide should float and the alundum should sink. Since silicon carbide is black and alundum is white, the quality of the separation could be determined by visual examination of the separated fractions. The results as presented in Table I clearly show that: (a) for a given particle size, the separation improves as the magnetization of the ferrofluid is lowered; (b) for a given ferrofluid magnetization, the quality of separation increases with increasing particle size. The first four tests performed were carried out in a kerosene based ferrofluid. A fifth test was performed in a perfluorinated based ferrofluid.

TABLE I

SEPARATION OF POWDERS BY MAGNETIC FLUID LEVITATION

Mixture Compositions: Alundum: 59% by weight, $\rho = 4.0$ gm/cm³
Silicon Carbide: 41% by weight, $\rho = 3.2$ gm/cm³
Total Particle Concentration: $\epsilon_v = 0.05$ volume fraction
Apparent Density of ferrofluid: 3.6 gm/cm³

| Size of Granules Mesh Range | Size of Granules Mean Diameter (Microns) | Fluid Saturation Magnetization $4\pi M_s$ Gauss | Applied Magnetic Field Gradient, Γoe/cm | Calculated Values of $F_{ss}/F_1$ A(Eq. 2) a = D | Calculated Values of $F_{ss}/F_1$ B(Eq. 4) a = d | Results |
|---|---|---|---|---|---|---|
| −30/+40 | 500 | 100 * | 400 | 10.0 | .45 | Good separation |
| −30/+40 | 500 | 50 ** | 800 | 2.54 | .105 | Excellent separation |
| −50/+80 | 240 | 100 | 400 | 21.1 | .93 | Poor separation |
| −50/+80 | 240 | 50 | 800 | 5.3 | .23 | Good separation |
| −140/+200 | 90 | 25 *** | 1050 | 3.5 | .153 | Excellent separation |

* - true density - 0.86 gm/cm³
** - true density - 0.81 gm/cm³
*** - true density - 1.79 gm/cm³
(HFPO Decamer - FREON E-3 Ferrofluid)

The ratio $F_{ss}/F_1$ was first calculated according to Equation (2) where it is assumed that the particles come into physical contact. From the data, it appears that using a value of $F_{ss}/F_1 < 1$ calculated on the basis of Equation (2), may be too severe a criterion of whether or not separation will occur. In this equation, particle concentration is not taken into account. For example, in Run 2 of the foregoing example, there was excellent separation, even though the calculated value of $F_{ss}/F_1 = 2.5$, based on the mean particle diameter of the powder in the sample. Furthermore, this number is a conservative estimate because particles smaller than the mean, which have a larger value of $F_{ss}/F_1$ than the one calculated, will be the first to interact and these, in fact, did not interact.

The ratio $F_{ss}/F_1$ may also be calculated on the basis of Equation (4), which assumes that the particles are uniformly spaced through the ferrofluid and that particle separation is a function of particle concentration. In all cases, even where there was relatively poor separation, the calculated values of $F_{ss}/F_1$ are less than unity. This indicates that computing a value of $F_{ss}/F_1 < 1$ based on an assumed mean particle separation is not stringent enough a criterion of the quality of separation. The value should be based upon assumed physical contact and for practice of this invention $F_{ss}/F_1 < 10$, based upon an Equation (2) computation.

While it is not clearly understood why good separation can be achieved empirically with the ratio $F_{ss}/F_1$ greater than one, it is probably a combination of the following effects. Firstly, the particles are not true spheres. The calculations were made on the assumption that the vector of the field and the vector of the gradient are parallel. In practice, they are not.

Reducing the volumetric concentration of particles in suspension results in improved separation. Decreasing the particle concentration decreased the average inter-particle separation. This not only decreases the average value of $F_{ss}$, but also decreases the probability of contact between two particles. At a sufficiently low concentration the probability of particle contact should be negligibly small. A balance exists between probability of contact and the fact that close encounters between powder particles, irrespective of the average separation, are those which will result in inter-particle attraction forces thus degrading the quality of separation.

A related factor which may arise in the operation of the device is the interaction of the powder particles with the walls of the separation vessel. An attractive force between a non-magnetic particle in a ferrofluid and the non-magnetic wall (which can be treated as a sphere of large radius) can exist. By properly designing the magnetic field source these forces can be cancelled by oppositely directed horizontal magnetic field gradients which would tend to push the particles away from the vessel walls.

Figure 2:
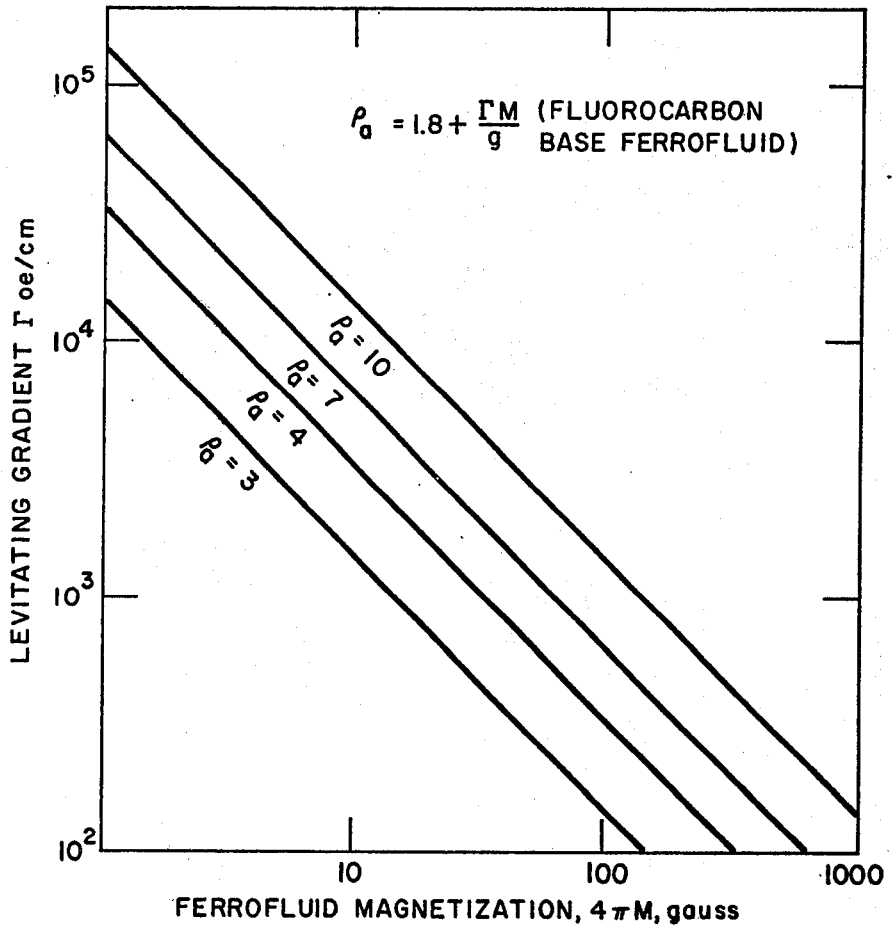
FIG. 2 is a graph of levitating gradient as a function of ferrofluid apparent density and ferrofluid magnetization.

The design of a fine particle separator will be determined by particle interaction effects. Such effects can be made small by using low magnetization ferrofluids and high field gradients. FIG. 2 shows the effect of ferrofluid apparent density and ferrofluid magnetization on intensity of levitating gradient.

Figure 3:
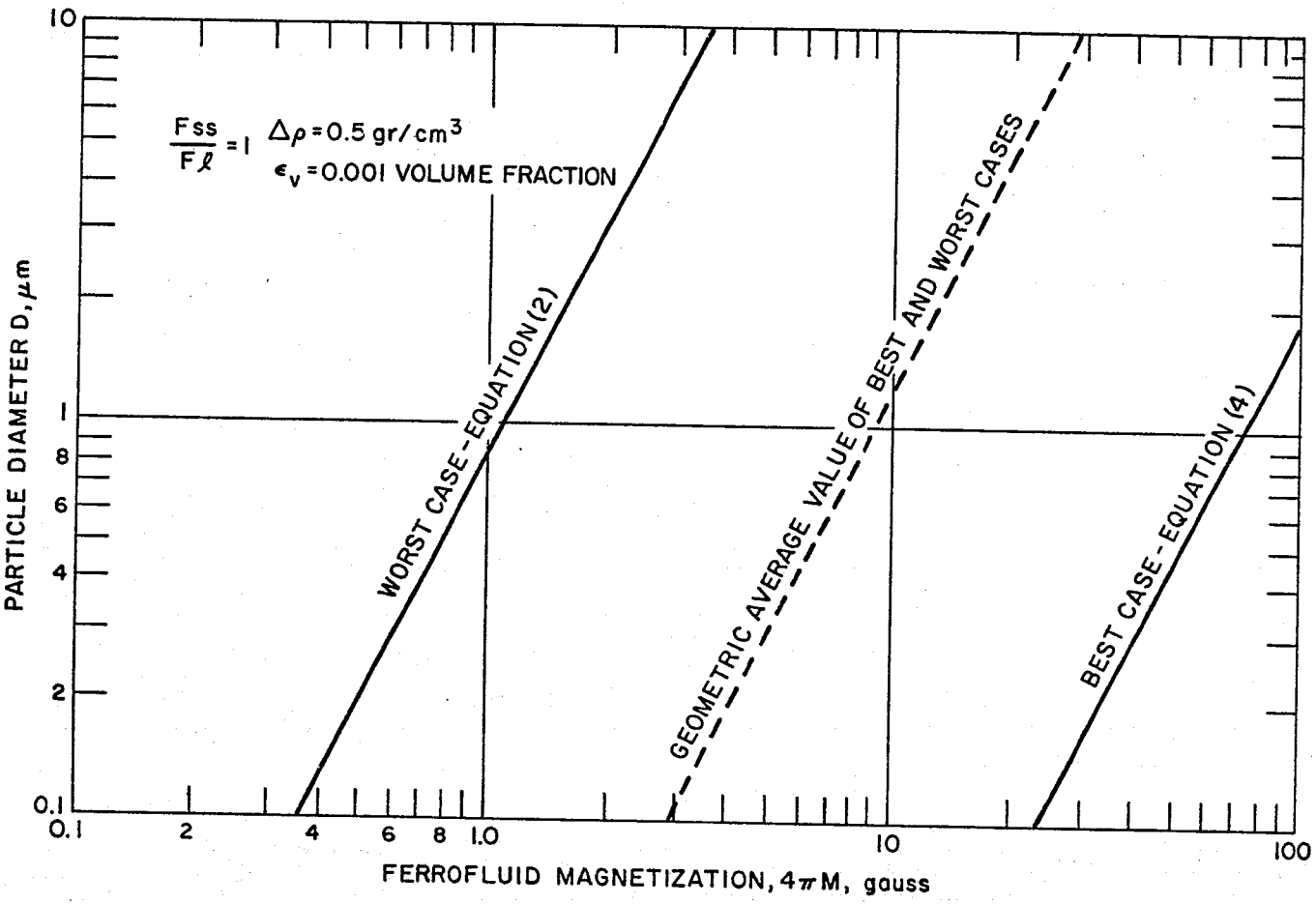
FIG. 3 is a graph of density discrimination as a function of particle size and ferrofluid magnetization.

The possible range of ferrofluid magnetization required to separate particles smaller than 10 $\mu$m in size, with a density discrimination of 0.5 gr/cm$^3$, is presented in FIG. 3. The range of the permissible values of ferrofluid magnetization as a function of particle size, for a value of $F_{ss}/F_1 = 1$ is bound by curves predicted by Equation (2) as the most pessimistic estimate and by Equation (4) for a value of $\epsilon_v = 0.001$, as the most optimistic estimate. The geometric mean of the extreme values is assumed as a probable operating line. According to this figure the separation of particles 10 $\mu$m in diameter, that differ in density by 0.5 gr/cm$^3$, will occur if ferrofluids with a magnetization of less than 4 gauss are used, but may actually occur, at the assumed particle concentration level, with ferrofluids with a magnetization of less 30 gauss. For particles 1 $\mu$m in diameter, the corresponding magnetizations are approximately 1 gauss and 9 gauss.

Figure 4:
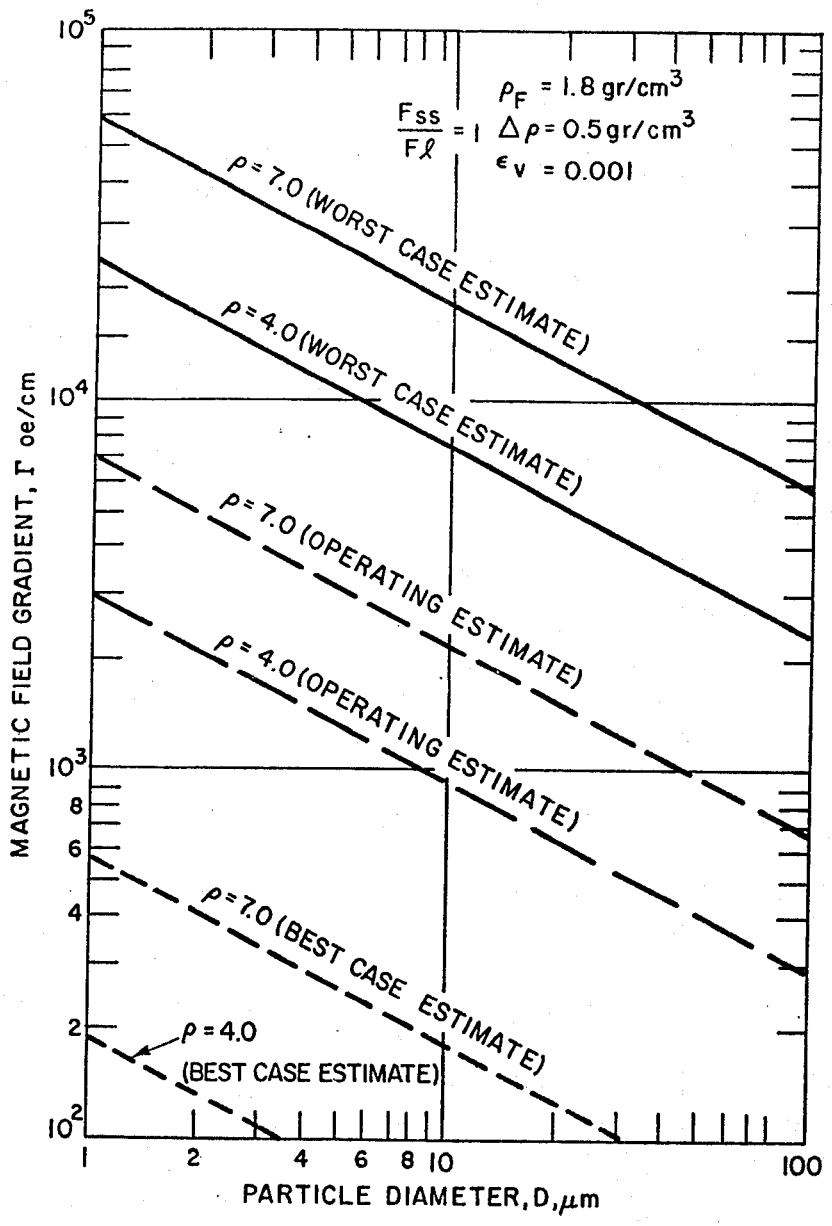
FIG. 4 is a graph of estimated magnetic gradient required for fine particle separation in a fluorocarbon ferrofluid.

The magnetic field gradient required to levitate particles of density 4 gr/cm$^3$ and 7 gr/cm$^3$, with a discrimination of 0.5 gr/cm$^3$ in a fluorocarbon ferrofluid of density of 1.8 gr/cm$^3$ is presented in FIG. 4 as a function of particle size. FIG. 4 is based on the values of $M$ predicted in FIG. 3. The worst case is based on the calculation of $M$ according to Equation (2), the best case is based on values of $M$ obtained from Equation (4), using a value of $\epsilon_v = 0.001$. The operating estimate is based on the geometric mean of the above limiting values of $M$.

Using the geometric mean, it should be possible to carry out a separation of particles 10 $\mu$m or larger at a density level of 7 gr/cm$^3$ to within 0.5 gr/cm$^3$ with an applied gradient of 2200 oe/cm. In this instance, the corresponding ferrofluid magnetization is 29 gauss. Smaller particles will require the application of greater gradients. Under these conditions, gradients of 5000 oe/cm and 7000 oe/cm would be required for separations of 2$\mu$m and 1 $\mu$m particles, respectively. Lower gradients would be required to separate these particles at a lower density. At a density of 4.0 gr/cm$^3$ the required gradient for the separation of particles as small as 1 $\mu$m would be 3000 oe/cm.

This theoretical calculation indicates that the capabilities of existing laboratory separators, which can generate a maximum gradient of about 1000 oe/cm are adapted to practice of this invention particularly with a fluorocarbon ferrofluid, such as is hereinafter described.

The foregoing theoretical discussion shows that the magnetic field gradients required for commercial scale clean separation of really fine particles are largely outside the capabilities of magnetic structures available to the art. In practice the gradients that can be produced by magnets for industrial scale separation systems are about 250 oe/cm, and with foreseeable design improvements about 320 oe/cm. This reality is nearly off of the curves illustrated in FIGS. 2, 3 and 4.

Conversely, the foregoing theoretical discussion indicates that clean separation of mixtures by sink-float in a ferrofluid subjected to the field gradients actually obtainable, e.g., about 300 oe/cm, requires removal of particles smaller than whatever diameter is indicated by the $F_{ss}/F_1$ 10 relationship. Indeed the separation may even require a safety factor and a need to screen out particles smaller than $F_{ss}/F_1 = 5$ or even 2.

EXAMPLE 2

Shredded automobiles contain appreciable quantities of all the materials originally in the automobile. After separation out of the ferrous metals and non-metallic constituents, mixtures of lead, zinc (die cast alloy), aluminum and copper result. Relatively pure scrap metal, if obtainable by sharp separation has the highest value. Thus, separating lead from zinc results in higher value products if the zinc is pure.

The zinc may be employed directly as secondary die cast if recovered with a lead content less than 0.003%. To be safe, an $F_{ss}/F_1 = 2$ is employed for determining minimum particle size for separation of a zinc-lead mixture.

| | |
|---|---|
| $\rho_{lead}$ | = 11.3 gm/cm$^3$ |
| $\rho_{zinc}$ | = 6.6 gr/cm$^3$ |
| $\Delta\rho$ | = 4.7 gr/cm$^3$ |
| $\rho_{average}$ | = 9.45 gr/cm$^3$ |

Using for separation a kerosene base ferrofluid of $\rho = 1.3$ gr/cm³:

| | | |
|---|---|---|
| $\Gamma_{max}$ | 250 oe/cm | 320 oe/cm |
| $M\Gamma/g$ | 8.15 | 8.15 |
| M | 32.0 | 25.0 |
| $4\pi M$ | 402 gauss | 340 gauss |
| $(4\pi M)^2$ | | |
| $8\pi(\Delta\rho)$ gd | 1.39 | 0.85 |
| for $F_{ss}/F_1 = 2$ $D_{max} = 0.70$ cm or 1/4" | | 0.42 cm or 1/6" |

The feed to the separator should be screened to 5 mesh and larger for the values of $4\pi M$ cited. The "fines" may of course be classified separately in another system where $\Gamma$ may be made larger and $4\pi M$ made smaller.

EXAMPLE 3

A test was undertaken to separate a copper shot-lead shot mixture $D = 0.2$ cm (feed rate 69 lb/hr) $\rho_{pb} = 11.3$ gm/cm³; $\rho_{Cu}$ 8.9 gm/cm³, and $\rho_{ff} = 1.30$ gm/cm³, $\rho_{app} = 10.1$; $4\pi M = 430$ gauss, $\Gamma = 250$ oe/cm. The float was 79% copper, 21% lead. The sink was 14% copper, 86% lead.

$F_{ss}/F_1 = 15.6$

The poor separation results were to be expected. Better, but borderline separation might be obtained if $d = 0.3$ cm on $F_{ss}/F_1 = 10$. For $d = 1.0$ cm the $F_{ss}/F_1 = 3.2$. Good separation is obtainable if the copper-lead mixture were pre-screened to remove particles smaller than about one-half inch.

All ferrofluids have the magnetic properties required for sink-float separation, and generally the many different ferrofluids heretofore suggested to the art are equivalent for sinkfloat separation. However, for best classification of particles, some attention must be paid to the ferrofluid itself.

Ferrofluids are very stable dispersions of single domain magnetic particles. The suspended particles are so small (typically less than 500 A) that they do not settle under gravity or interact even in the presence of a strong magnetic field. The magnetic response of a ferrofluid results from the coupling of individual particles with a substantial volume of the bulk liquid. This coupling is facilitated by a stabilizing agent which adsorbs on the particle surface and is also solvated by the surrounding liquid. This solvated layer is also responsible for the stability of the suspension. By proper choice of stabilizing agent, magnetic properties can be conferred to many liquids including fluorocarbons.

Figure 5:
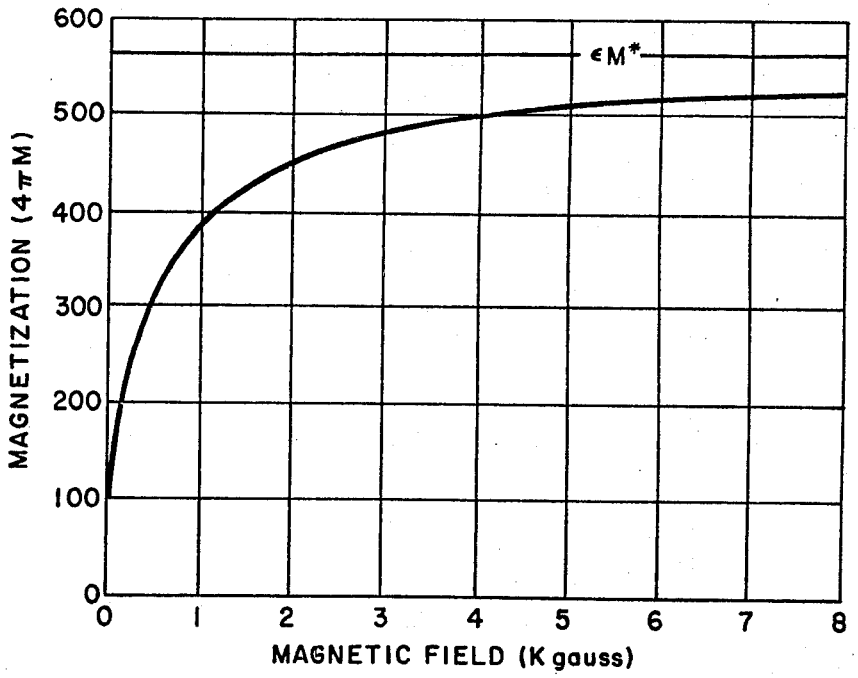
FIG. 5 is a graph of the magnetization curve of a typical ferrofluid.

The magnetic properties of a ferrofluid can best be described by considering the particles in a ferrofluid to behave as an assembly of non-interacting magnets. Their magnetic properties have been successfully correlated by superparamagnetic theory, taking into account the composition, size distribution, volume concentration and domain magnetization of the particles in suspension. In the absence of a magnetic field, they are randomly oriented and the ferrofluid has no net magnetization. In a magnetic field, the particles tend to align with the field resulting in a net induced fluid magnetization, $M$. The magnetization increases with increasing field until a saturation value is observed as shown in FIG. 5. Under these conditions the particle moments are all aligned in the direction of the applied field. As soon as the magnetic field is removed, the particles become randomly oriented again because of thermal motion. The ferrofluid, therefore, has no residual magnetization and does not exhibit hysteresis.

A ferrofluid remains a liquid in a magnetic field because the particles do not interact. A minor increase in viscosity (which can be made as small as desired) is noted because of the interaction of the particles with the field.

Perfluorinated ferrofluids are particularly well suited for practice of this invention and such ferrofluids are preferred, including notably perfluorinated ferrofluids prepared according to the teachings of U.S. Pat. No. 3,784,471.

Briefly stated, the perfluorinated ferrofluids are stable dispersions of magnetite in a perfluorinated liquid carrier and a surfactant, said surfactant having the following formula:

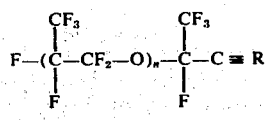

wherein $n$ is an integer of from 3 to 50, and wherein R is a member selected from the group consisting of:

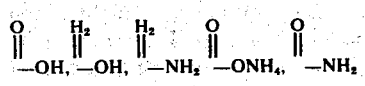

A preferred example of perfluorinated ferrofluid for practice of this invention is:

| Component | Composition | Concentration Volume Percent |
|---|---|---|
| Carrier liquid | FREON E-3 | Balance |
| Stabilizing agent | HFPO polymer carboxylic acid such as KRYTOX 157 | 1 |
| Magnetic colloid | Magnetite, $Fe_2O_3$ | 0.2 |

Stable ferrofluids prepared with these fluorinated agents proved to be excellent inert, non-toxic, dispersing and classifying media for many solid materials.

FREON E-3 (E. I. DuPont de Nemours Co.) is hydrogen terminated trimer of hexafluoropropylene oxide. KRYTOX 157 (DuPont) is a hexafluoropropylene oxide polymer carboxylic acid with a high molecular weight (M.W. = 2500). When it adsorbs on a superparamagnetic particle, it is solvated by FREON E-3, resulting in a stabilizing layer.

The relatively high density of these fluorinated compounds ($\rho = 1.8$ gr/cm³) is a desirable property. A smaller magnetic force will be required to levitate a dense particle on a fluorocarbon base ferrofluid than in a hydrocarbon or water base ferrofluid, for example. For a given applied gradient a ferrofluid of lower magnetization will be required to float a denser particle, or vice versa. Smaller particles can be separated efficiently.

EXAMPLE 4

Separation of zircon from kyanite in titanium beach sands — the particles vary from −80 mesh to +200 mesh, mean particle size estimated at about 115 μm.

kyanite = 3.7 gm/cm³ zircon = 4.7 gm/cm³

The test added 1.9414 gm powder (0.5 ml) to 10 ml of the fluorocarbon base ferrofluid described above and employed for the last run of Example 1.

| | |
|---|---|
| $M_{sat}$ = 28 gauss | $\rho_{ff}$ = 1.79 gm/cm³ |
| $\Gamma$ = 1150 oe/cm | $\rho_{app}$ = 4.2 gm/cm³ |

The 0.89 float contained only a trace of zircon. The 1.02 gm sink had a very high zircon content.

The degree of separation was determined by examination of samples under black light. Zircon fluoresces orange.

$$F_{ss}/F_1 = 2.76$$

Good separation is to have been expected.

Although the detailed structure of sink-float separator equipment does not form part of this invention, manifestly any actual separation is constrained by equipment considerations, such as, for example, the working volumes available in a high gradient magnet. Further elaboration on the principles and practices of this invention are best considered in light of magnetic equipment available to the art. Reference is made to the structure disclosed in copending and commonly assigned application, "Hyperbolic Magnet Poles for Sink-Float Separators", Ser. No. 454,373 filed Mar. 25, 1974, as an exemplary magnet adapted for a batch separation of small (analytical) samples. The expected concentration of sample particles in the ferrofluid is of the order of 0.1%. Approximately 1 ml–10 ml of ferrofluid is required. It may be noted that sinkfloat separation of such a sample is consistent with a high gradient magnet having a working height and width limit of about 2 cm. The gap length can be greater, e.g., 20 cm. Once the sample has been classified, the separated fractions can be maintained separate by insertion of horizontal barriers (at predetermined density levels) and the different cuts removed individually, e.g., by flushing out each cut separately with fresh ferrofluid.

From the preceding description of the preferred embodiments, it is evident that the objects of the invention are attained and although the invention has been described and illustrated in detail, it is to be clearly understood that the same is by way of illustration and example only and is not to be taken by way of limitation. The spirit and scope of the invention being limited only by the terms of the appended claims.

We claim:

1. A method of separating substantially non-magnetic particles of different densities where alone or in combination, the product of the difference in particle density and particle diameter is at most 5 gr/cm² or the difference in particle density is at most 0.1 gr/cm³ or the particle diameter is at most 1 cm comprising:

immersing said particles in a ferrofluid with a magnetic dipole moment of $M$, $M$ being computed from the ratio of particle attraction forces ($F_{ss}$) to particle separation forces ($F_1$) to be applied by the magnetized ferrofluid, and said ratio being made less than 10 where:

$$\frac{F_{ss}}{F_1} = \left(\frac{1}{8\pi}\right)\left(\frac{(4\pi M)^2}{(\rho 2-\rho 1)}\right)\left(\frac{D^3}{ga^4}\right)$$

$M$ = magnetic dipole moment per unit volume of ferrofluid $\rho 2$ = density of the more dense particles $\rho 1$ = density of the less dense particles $D$ = dimeter of the particles $g$ = acceleration of gravity; cm/sec²

$a$ = center to center spacing between particles applying a magnetic field to said ferrofluid capable of overcoming the forces produced by gravity and interparticle magnetic attraction to levitate the least dense particles in said ferrofluid, whereby the particles are classified into relatively pure fractions; and collecting the individual fractions.

2. A method as in claim 1 wherein said ferrofluid comprises a perfluorinated surfactant and a fluorinated liquid carrier.

3. The ferrofluid of claim 2 wherein the perfluorinated surfactant has the following formula:

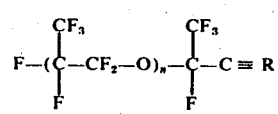

wherein $n$ is an integer of from 3 to 50, and wherein R is a member selected from the group consisting of:

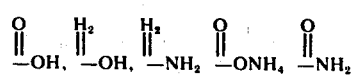

4. A method as defined in claim 1 wherein the non-magnetic particles are first prescreened to obtain particles wherein the product of the difference in particle density and particle diameter is at most 5 gr/cm².

5. A method as in claim 1 wherein the ratio is less than 5.

* * * * *